US008002689B2

(12) United States Patent
Whitten et al.

(10) Patent No.: US 8,002,689 B2
(45) Date of Patent: Aug. 23, 2011

(54) FOLDER WITH SIGNATURE REMOVAL AND SLOWDOWN PROCESS

(75) Inventors: Dave Elliott Whitten, Barrington, NH (US); John Lee Ketchum, Old Orchard Beach, ME (US)

(73) Assignee: Goss International Americas, Inc., Durham, NH (US)

( * ) Notice: Subject to any disclaimer, the term of this patent is extended or adjusted under 35 U.S.C. 154(b) by 984 days.

(21) Appl. No.: 11/368,980

(22) Filed: Mar. 6, 2006

(65) Prior Publication Data

US 2007/0207909 A1 Sep. 6, 2007

(51) Int. Cl.
*B31F 1/00* (2006.01)

(52) U.S. Cl. ..... 493/432; 493/441

(58) Field of Classification Search ..... 493/432, 493/441, 445, 428
See application file for complete search history.

(56) References Cited

U.S. PATENT DOCUMENTS

| | | | | |
|---|---|---|---|---|
| 4,605,212 | A | 8/1986 | Kobler | |
| 4,629,175 | A * | 12/1986 | Fischer et al. | 271/202 |
| 4,697,805 | A * | 10/1987 | Herb | 270/47 |
| 4,817,932 | A * | 4/1989 | Stab et al. | 270/47 |
| 4,974,822 | A | 12/1990 | Richter | 270/48 |
| 5,013,020 | A * | 5/1991 | Stoll | 270/49 |
| 5,102,111 | A | 4/1992 | Reponty | 270/12 |
| 5,226,871 | A * | 7/1993 | Skipor | 493/425 |
| 5,236,188 | A * | 8/1993 | Breton et al. | 271/187 |
| 5,425,697 | A | 6/1995 | Lanvin | 493/426 |
| 5,429,578 | A | 7/1995 | Calbrix et al. | 493/359 |
| 5,443,256 | A | 8/1995 | Ertavi et al. | 271/277 |
| 5,807,227 | A * | 9/1998 | Field | 493/424 |
| 6,270,067 | B1 | 8/2001 | Bergmann | |
| 6,585,263 | B1 * | 7/2003 | Bredenberg et al. | 271/276 |
| 6,923,753 | B2 | 8/2005 | Jackson et al. | 493/432 |

FOREIGN PATENT DOCUMENTS

JP 2-4857 1/1990

* cited by examiner

*Primary Examiner* — Sameh H. Tawfik
(74) *Attorney, Agent, or Firm* — Davidson, Davidson & Kappel, LLC

(57) ABSTRACT

A folder includes a cylinder having a first gripping device receiving a folded edge of a signature and rotating the signature at a first surface speed. A conveyor presses the signature against the outer surface and the conveyor contacts the signatures at a second surface speed slower than the first surface speed. The present invention also provides a method for removing signatures from a cylinder.

8 Claims, 4 Drawing Sheets

FOLDER WITH SIGNATURE REMOVAL AND SLOWDOWN PROCESS

BACKGROUND

The present invention relates generally to printing presses and more particularly to a folder of a printing press.

Several processes have been used previously to remove signatures from a half fold jaw. U.S. Pat. No. 5,102,111, hereby incorporated by reference herein, discloses a folder or folding machine apparatus for a printing machine. A first conveyor conveys signatures at a given speed at a same speed as the printing press, the signatures are then stripped by strippers.

BRIEF SUMMARY OF THE INVENTION

The present invention provides a folder comprising:

a cylinder having a first gripping device receiving a folded edge of a signature and rotating the signature at a first surface speed, and a conveyor pressing the signature against the outer surface, the conveyor contacting the signature at a second surface speed lower than the first surface speed.

By having a second surface speed lower than the first, the conveyor can aid in removing the signature from the cylinder The present invention also provides a method for removing signatures from a cylinder comprising the steps of:

transporting the signatures around a cylinder at a first surface speed, the signatures being gripped at a folded edge by a gripping device;

pressing the signatures with a first conveyor against the cylinder, the first conveyor moving at a second surface speed lower than the first surface speed;

releasing the signatures from the gripping device; and further transporting the signatures.

BRIEF DESCRIPTION OF THE DRAWINGS

Preferred embodiments of the present invention will be elucidated with reference to the drawings, in which.

DETAILED DESCRIPTION OF THE PREFERRED EMBODIMENTS

Figure 1:
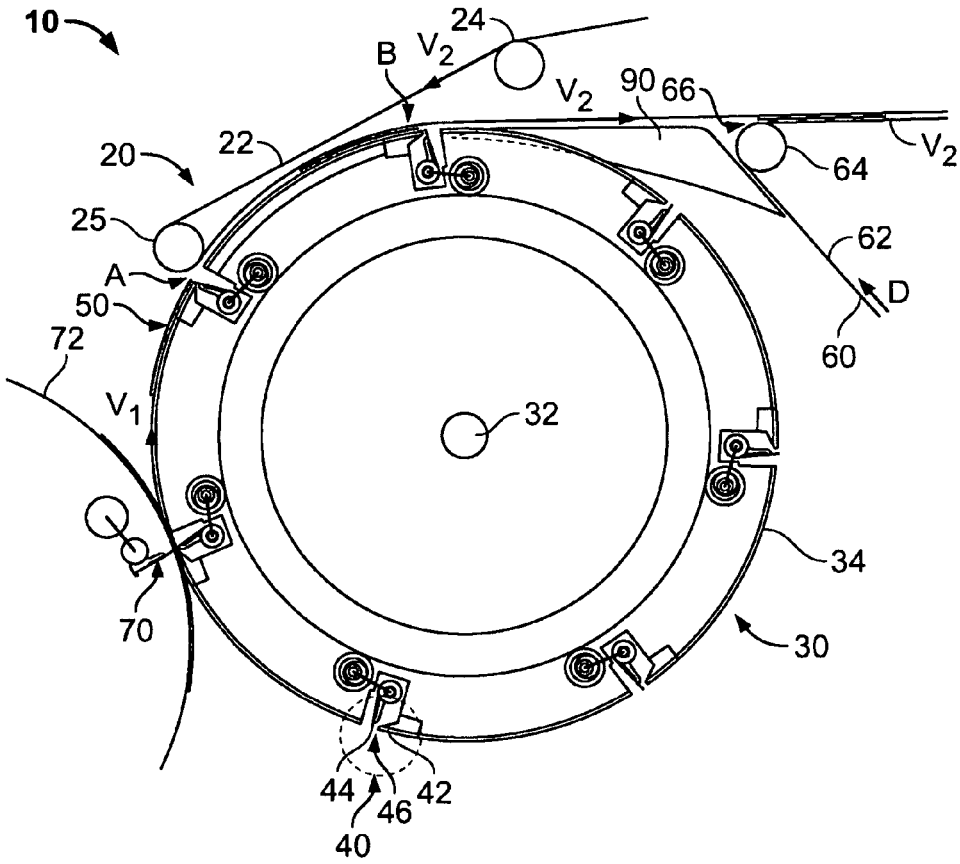
FIG. 1 shows a folder according to the present invention.

FIG. 1 shows a preferred exemplary embodiment of a folder 10. Folder 10 includes a jaw cylinder 30, a first conveyor 20, a second conveyor 60 and a stationary support such as stripper 90. Jaw cylinder 30 includes a gripping device 40. Gripping device 40 includes a stationary part 42, a movable jaw 44 and a jaw gap 46. Jaw cylinder 30 may include a plurality of gripping devices 40 spaced axially and circumferentially. Jaw cylinder 30 moves at a velocity $V_1$, rotationally driven about a central axis 32, shown in FIG. 1. in the clockwise direction. Jaw cylinder 30 has an outer surface 34 with circumferentially extending grooves between the axially spaced gripping devices 40 and a plurality of axially spaced strippers 90 may at least be partially located in these grooves.

First conveyor 20 includes a belt 22 and a plurality of rollers 24, 25. Belt 22 moves around roller 24 and roller 25 at a velocity $V_2$ in the direction indicated in FIG. 1. Second conveyor 60 includes a belt 62 and a roller 64. Belt 62 moves around roller 64 at velocity $V_2$ in the direction D indicated in FIG. 1. $V_2$ is less then $V_1$ at least when belt 22 presses signature 50 against outer surface 34.

Figure 2:
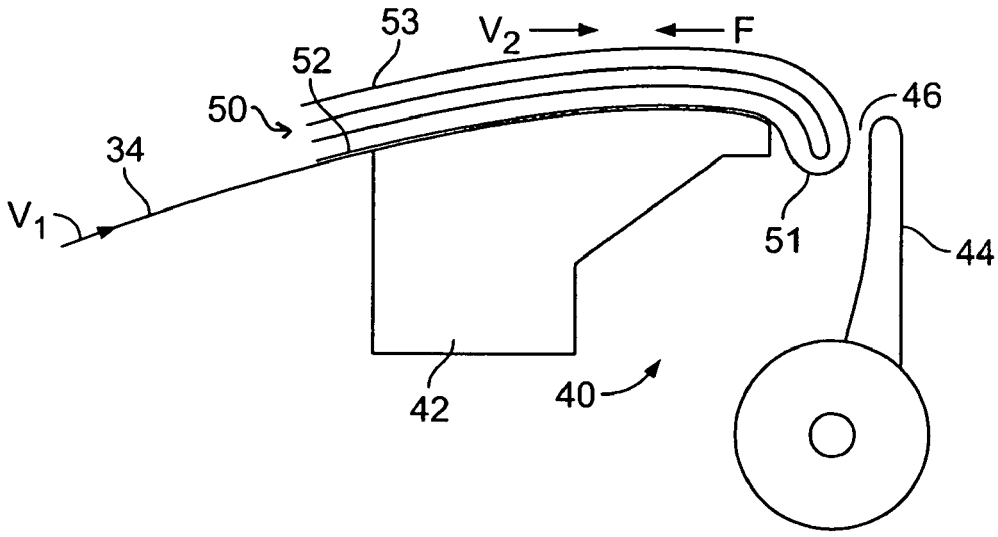
FIG. 2 shows an enlarged view of a gripping device.

Tucking blade 70 from a transfer cylinder 72, for example, the transfer cylinder disclosed in U.S. Pat. No. 6,923,753, hereby incorporated by reference herein, tucks a signature 50 into jaw gap 46. Movable jaw 44 pushes against signature 50 to place folded edge 51 in jaw gap 46 in between movable jaw 44 and stationary part 42 (FIG. 2).

Gripping device 40 holds signature 50 as signature 50 travels around jaw cylinder 30 at velocity $V_1$. When jaw cylinder 30 reaches a point A in the jaw cylinder rotation, cam/cam follower interaction may, for example, cause movable jaw 44 to release signature 50.

At a point beyond point A, belt 22 presses signature 50 against jaw cylinder 30. Belt 22 moving at slower velocity $V_2$ guides signature 50 along a segment of jaw cylinder 30 between point A and a point B. Thus, due to the difference between $V_2$ and $V_1$, folded edge 51 slides out of gripping device 40.

After point B, belt 22 continues to carry signature 50 away from jaw cylinder 30 at velocity $V_2$. Stationary stripper 90 rests partially in circumferentially extending grooves of jaw cylinder 30 and is positioned to intercept signature 50, as signature 50 travels along outer surface 34. Signature 50 slides along stationary stripper 90 to a gap 66 located between belt 22 and belt 62. Belt 22 and belt 62 move at velocity $V_2$ and transport signature 50 along for further processing.

FIG. 2 shows an enlarged view of gripping device 40. Gripping device 40 includes stationary part 42, jaw gap 46 and movable jaw 44. Signature 50 includes folded edge 51, a lower surface 52 and an upper surface 53.

As shown in FIG. 2, due to slower velocity $V_2$ on upper surface 53 of signature 50, a force F develops on signature 50 which pulls folded edge 51 out of jaw gap 46 after movable jaw 44 releases at point A. Accordingly, strippers 90 (FIG. 1) can be used at a reduced capacity.

As force F pulls on signature 50, upper surface 53 may slide in the same direction as F. The fold position of folded edge 51 or lap of the signature thus may be altered by slower speed $V_2$. The speed $V_2$ can be set as a function of the fold position set by tucking blade 70, so the fold position as signature 50 exits jaw cylinder 30 is as desired, for example, exactly half of a signature. Outer surface 34 is preferably cylindrical with a relatively high finish or friction reducing substance so signature 50 slides on outer surface 34 when force F is applied to upper surface 53. Stripper 90 also preferably has a high finish or friction reducing substance on its contact surface. Also, it should noted that stripper 90 may have a curved or cylindrical top surface to aid signature slip.

Figure 3:
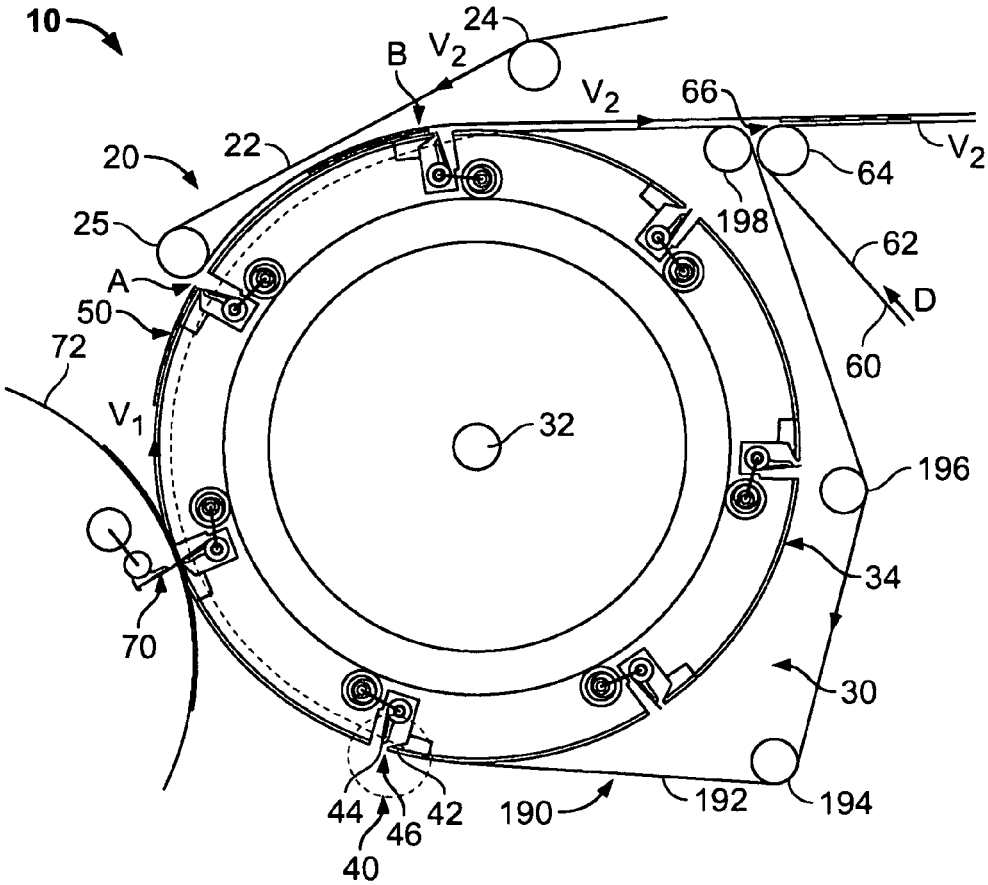
FIG. 3 shows a second embodiment of the folder according to the present invention.

FIG. 3 shows a second embodiment with a movable support 190 instead of stationary support 90. Movable support 190 includes tapes 192 and a plurality of rollers 194, 196, 198. Tapes 192 move around roller 198, roller 196, roller 194 and around jaw cylinder 30. Tapes 192 travel along outer surface 34 recessed in a plurality of grooves 36 (see FIG. 4) as to not interfere with gripping device 40 or tucking blade 70. At or soon thereafter point B, tapes 192 exit jaw cylinder 30 and contact a signature 50 as tapes 192 surface on outer surface 34.

Signature 50 leaves jaw cylinder 30 transported between tapes 192 and belt 22. Second conveyor 60 is positioned to receive signature 50 from tapes 192 and belt 22. Thus, signature 50 enters a gap 66 located between belt 22 and belt 62. Belt 22 and belt 62 move at velocity $V_2$ and transport signature 50 along for further processing. Conveyor 20, conveyor

60 and roller 198 can also be located at a different angle with respect to jaw cylinder 30 so gravity effects can be further minimized.

Figure 4:
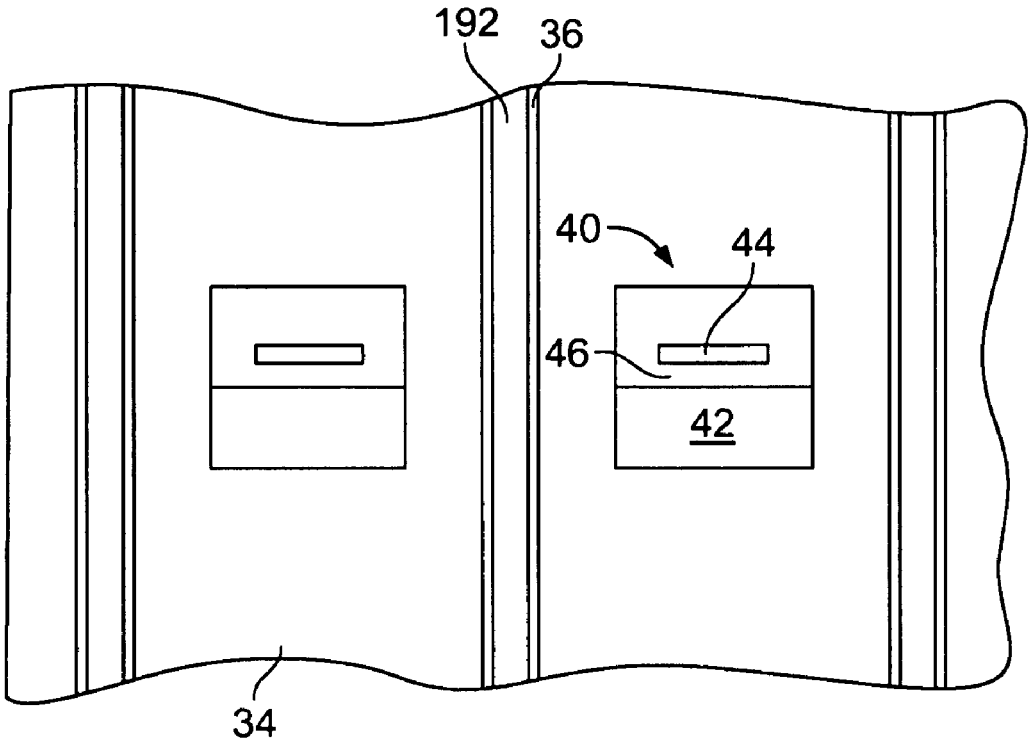
FIG. 4 shows an outer surface of the folder of FIG. 3.

FIG. 4 shows tapes 192 in circumferentially extending grooves 36. Grooves 36 are recessed in outer surface 34. Tapes 192 are spaced around gripping device 40 as to not interfere with gripping device 40. Tapes 192 move in grooves 36 around outer surface 34. Tapes 192 may move for example at speed $V_1$ or $V_2$ so as to slip with respect to cylinder 30 in grooves 36.

The speed $V_2$ with respect to $V_1$ may be determined as a function of various variables, such as paper type, surface friction present, belt material, types of strippers used, if any. The speed $V_2$ may be for example 75 to 95% of $V_1$, for example 86%. However, other speed percentages may be possible within the scope of the present invention.

Gripping device as defined herein can be any device for receiving a fold of a signature.

Tapes 192 may be rounded belting or other conveyor material.

What is claimed is:

1. A folder comprising:

a cylinder having a first gripping device receiving a folded edge of a signature and rotating the signature at a first surface speed; and a conveyor pressing the signature against an outer surface of the cylinder while the conveyor contacts the signature at a second surface speed lower than the first surface speed.

2. The folder as recited in claim 1 wherein the conveyor is a belt.

3. The folder as recited in claim 1 wherein the second surface speed is less than the first surface speed.

4. The folder as recited in claim 1 wherein the second surface speed is between 75% and 95% of the first surface speed.

5. The folder as recited in claim 1 further comprising a second conveyor receiving signatures from the conveyor.

6. The folder as recited in claim 1 wherein the cylinder is a jaw cylinder.

7. The folder as recited in claim 1 further comprising a stationary or fixed stripper located next to the cylinder.

8. The folder as recited in claim 1 further comprising a moving support located within a circumferential groove of the cylinder.

* * * * *